US005507257A

United States Patent [19]

Sakai et al.

[11] Patent Number: 5,507,257

[45] Date of Patent: Apr. 16, 1996

[54] VALUE GUIDE MEMBER FORMED OF FE-BASED SINTERED ALLOY HAVING EXCELLENT WEAR AND ABRASION RESISTANCE

[75] Inventors: Masaaki Sakai; Takashi Kobayashi; Kazuyuki Hoshino, all of Niigata; Ichiro Tanaka; Masashi Sasaki, both of Kyoto, all of Japan

[73] Assignees: Mitsubishi Materials Corporation; Mitsubishi Jidosha Kogyo Kabushiki Kaisha, both of Tokyo, Japan

[21] Appl. No.: 230,124

[22] Filed: Apr. 20, 1994

[30] Foreign Application Priority Data

Apr. 22, 1993 [JP] Japan ..... 5-119163
Apr. 22, 1993 [JP] Japan ..... 5-119164

[51] Int. Cl.[6] ..... F01L 3/02; F01L 3/08

[52] U.S. Cl. ..... 123/188.3; 123/188.9

[58] Field of Search ..... 123/188.3, 188.9; 251/368

[56] References Cited

U.S. PATENT DOCUMENTS 4,344,795 8/1982 Endo et al. .
4,632,074 9/1985 Takahashi et al. ..... 123/188.3
5,076,866 12/1991 Koike et al. ..... 123/188.3

FOREIGN PATENT DOCUMENTS 112206 9/1978 Japan ..... 123/188.3
2-077552 3/1990 Japan .
3-047952 2/1991 Japan .
450412 2/1992 Japan ..... 123/188.9
979414 1/1965 United Kingdom .
1580689 12/1980 United Kingdom .
2073247 10/1981 United Kingdom .
2104551 3/1983 United Kingdom .

*Primary Examiner*—Henry C. Yuen
*Assistant Examiner*—Erick Solis
*Attorney, Agent, or Firm*—Frishauf, Holtz, Goodman, Langer & Chick

[57] ABSTRACT

A valve guide member for internal combustion engines is formed of an Fe-based sintered alloy having excellent wear and abrasion resistance, consisting essentially, by weight %, of 1 to 4% C, 1.5 to 6% Cu, 0.1 to 0.8% P, and if required 0.05 to 1% Mo, and the balance of Fe and inevitable impurities, the Fe-based sintered alloy having a structure having a matrix formed mainly of pearlite, in which are dispersed hard Fe—C—P compounds and free graphite, or alternatively hard Fe—C—P compounds, carbides, and free graphite when the alloy contains Mo, the free graphite including 0.5 to 10 area % coarse free graphite having a particle diameter of 70 to 500 μm.

4 Claims, 2 Drawing Sheets

VALUE GUIDE MEMBER FORMED OF FE-BASED SINTERED ALLOY HAVING EXCELLENT WEAR AND ABRASION RESISTANCE

BACKGROUND OF THE INVENTION

1. Field of the Invention

This invention relates to a valve guide member as one of component members of an internal combustion engine, which is formed of an Fe-based sintered alloy having excellent wear and abrasion resistance.

2. Prior Art

It is well known that conventionally a great many Fe-based sintered alloys have been used as valve guide members in internal combustion engines.

In recent years, internal combustion engines have made remarkable progress in output and speed characteristics so that they exhibit higher output and higher speed performance, and accordingly component members constituting the internal combustion engines are used under severer conditions. These component members include valve guide members for guiding inlet valves and exhaust valves of the engine which are slidably fitted in bores formed in the valve guide members for reciprocating motion. The valve guide members undergo heavy wear and abrasion due to sliding contact with the valves (valve stems). Therefore, further improved wear and abrasion resistance is required of the valve guide members. In actuality, however, the conventional valve guide members formed of Fe-based sintered alloys do not exhibit satisfactory wear and abrasion resistance to cope with the wear and abrasion due to the sliding contact.

SUMMARY OF THE INVENTION

It is, therefore, the object of the invention to provide a valve guide member for internal combustion engines, which is formed of an Fe-based sintered alloy having excellent wear and abrasion resistance.

To attain the above object, the present invention provides an Fe-based sintered alloy consisting essentially of 1 to 4% C, 1.5 to 6% Cu, 0.1 to 0.8% P, and the balance of Fe and inevitable impurities. The alloy may further contain 0.05 to 1% Mo, if required. The Fe-based sintered alloy has a structure having a matrix formed mainly of pearlite, in which are dispersed hard Fe—C—P compounds and free graphite, or alternatively hard Fe—C—P compounds, carbides and free graphite when the alloy contains Mo. The free graphite includes 0.5 to 10 area % coarse free graphite having a particle diameter of 70 to 500 μm.

The above and other objects, features, and advantages of the invention will become more apparent from the following detailed description.

DETAILED DESCRIPTION

Figure 1:
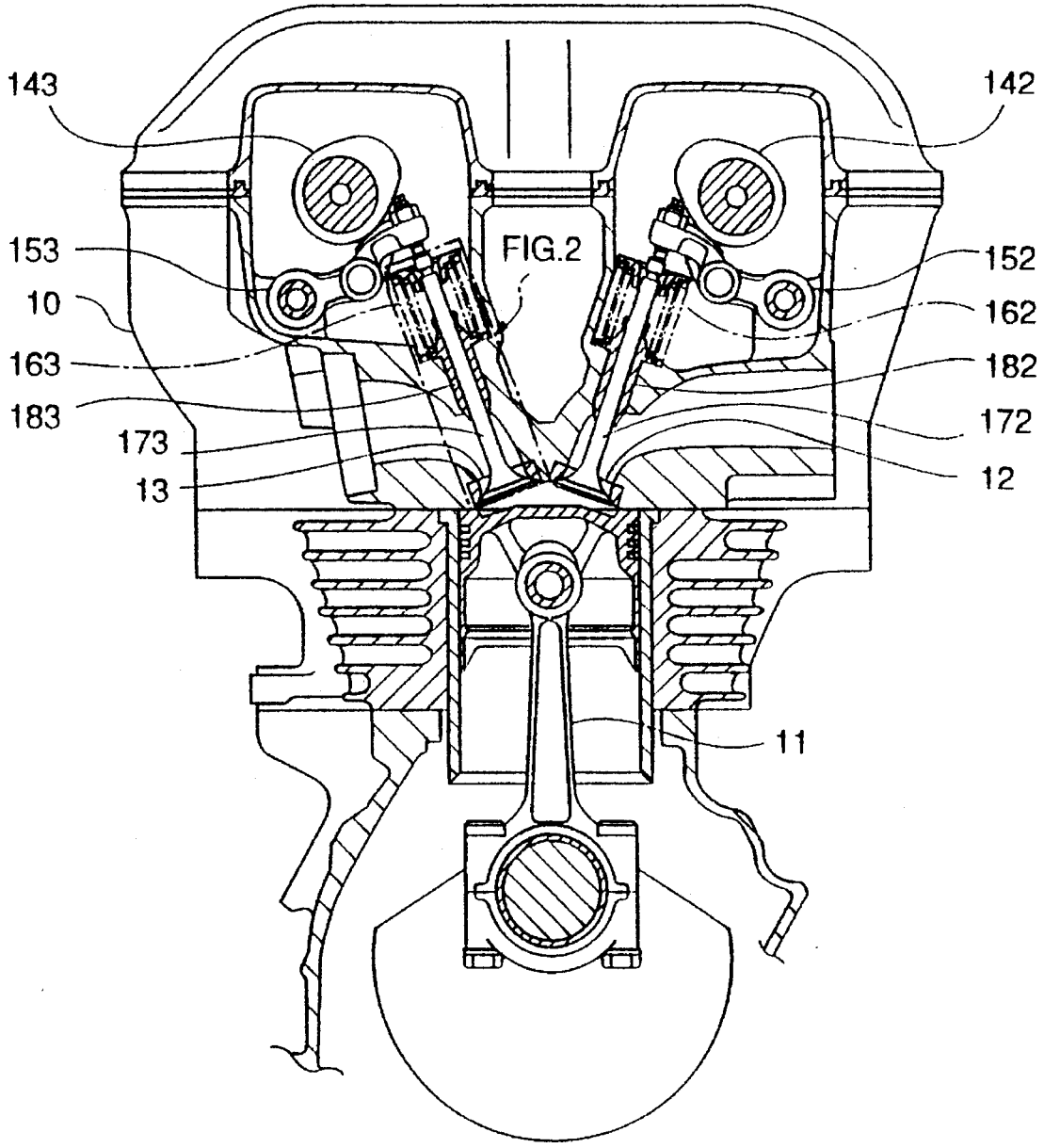
FIG. 1 is a highly schematic longitudinal cross sectional view through an internal combustion engine, and illustrating intake and exhaust valves and valve guide members.

An internal combustion engine in which the valve guide members of the present invention are usable has the convention elements of a cylinder head 10, a piston 11, a first valve 12, a second valve 13, two cam shafts and cams 142, 143, two rocker arms 152, 153 and valve springs 162, 163. The valve stems 172, 173 are guided within valve guide members 182, 183 disclosed in detail below in accordance with this invention.

Figure 2:
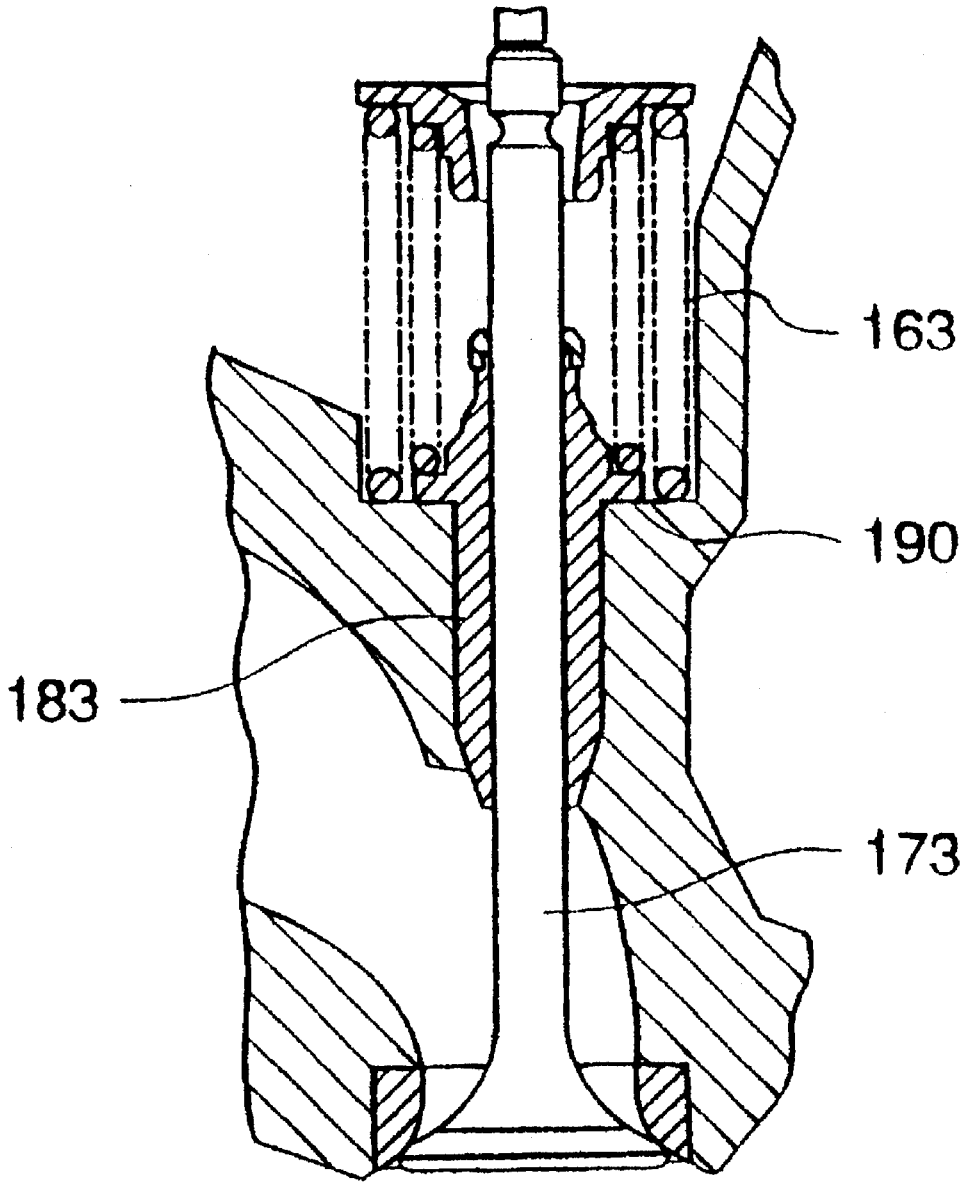
FIG. 2 is an enlarged fragmentary view showing the valve guide members and the region in which the valve guide members are mounted.

FIG. 2 illustrates the valve guide members 182, 183 guiding the valve stem 173 in greater detail. The valve guide members 182, 183 are generally cylindrical elements with a central bore in which the valve stem 173 slides. Lateral projection 190 is provided on the valve guide members 182, 183 to insure reliable placement of the respective valve guide members in the cylinder head structure.

It is immaterial whether the first and second valves are, respectively, intake valves or exhaust valves. The valve guide members 182, 183 can be identical, and used for either an intake or an exhaust valve.

Under the above stated circumstances, the present inventors have made many studies in order to obtain a valve guide member formed of an Fe-based sintered alloy which exhibits excellent wear and abrasion resistance under severe conditions, and reached the following findings:

If a valve guide member is formed of an Fe-based sintered alloy consisting essentially of 1 to 4% C, 1.5 to 6% Cu, 0.1 to 0.8% P, and if required 0.05 1% MO, and the balance of Fe and inevitable impurities, the Fe-based sintered alloy having a structure having a matrix formed mainly of pearlite, in which are dispersed hard Fe—C—P compounds and free graphite, or alternatively hard Fe—C—P compounds, carbides and free graphite when the alloy contains Mo, the free graphite including 0.5 to 10 area % coarse free graphite having a particle diameter of 70 to 500 μm, the valve guide member formed of the resulting Fe-based sintered alloy shows improved hardness due to the presence of the hard Fe—C—P compounds, or due to the presence of the hard Fe—C—P compounds and the carbides when Mo is added, and also shows an improved self-lubricating effect due to the action of the free graphite, especially due to the action of the coarse free graphite, whereby these improvements cooperatively serve to exhibit further excellent wear and abrasion resistance.

The present invention is based upon the above findings.

Throughout the whole specification percentage is percent by weight unless otherwise specified.

The Fe-based sintered alloy forming the valve guide member according to the invention has the aforestated chemical composition and structure.

The contents of the component elements and the structure have been limited as mentioned hereinbefore, for the following reasons:

(A) Chemical Composition:

(a) C

The C component acts not only to form pearlite which mainly constitutes the matrix of the alloy to strengthen the same but also to form hard Fe—C—P compounds, or hard Fe—C—P compounds and carbides when the alloy contains Mo, to thereby improve the hardness of the alloy. Further, the C component is dispersed in the matrix in the form of free graphite including coarse free graphite to remarkably improve the self-lubrication of the alloy, thereby further enhancing the wear and abrasion resistance of the alloy. However, if the C content is less than 1%, the above actions cannot be performed to a desired extent, whereas, if the C content exceeds 4%, the alloy drastically embrittles to such an extent that desired strength cannot be maintained. Therefore, the C content has been limited to the range of 1 to 4%. Preferably, the C content should be limited to a range of 1.5 to 3%.

(b) Cu

The Cu component is solid solved in the matrix to strengthen the same, and acts to stabilize the pearlite matrix. However, if the Cu content is less than 1.5%, the above actions cannot be performed to a desired extent, whereas if the Cu content exceeds 6%, the above actions cannot show further improvement. On the contrary, if the Cu content exceeds 6%, the alloy is liable to embrittle. Therefore, the Cu content has been limited to the range of 1.5 to 6%. Preferably, the Cu content should be limited to a range of 2 to 4%.

(c) P

The P component acts not only to improve the sinterability of the alloy green compact to increase the strength of the alloy but also to form hard Fe—C—P compounds as mentioned above to thereby enhance the wear and abrasion resistance in cooperation with the free graphite. However, if the P content is less than 0.1%, the above actions cannot be performed to a desired extent. On the other hand, if the P content exceeds 0.8%, the alloy matrix becomes so hard that coarse Fe—C—P compounds are precipitated, resulting in degraded machinability of the alloy as well as an increased degree of damaging or abrading a counterpart member. Therefore, the P content has been limited to the range of 0.1 to 0.8%, and preferably, the P content should be limited to a range of 0.2 to 0.4%.

(d) Mo

The Mo component may be contained in the alloy if required, because the Mo component is solid solved in the alloy matrix to strengthen the same, and acts to form carbides to further improve the hardness of the alloy matrix, to thereby enhance the wear and abrasion resistance. However, if the Mo content is less than 0.05%, the desired effects cannot be obtained, whereas if the Mo content exceeds 1%, the machinability of the alloy is degraded. Therefore, the Mo content has been limited to the range of 0.05 to 1%, and preferably it should be limited to a range of 0.2 to 0.6%.

(B) Coarse Free Graphite:

In producing a free graphite-dispersed Fe-based sintered alloy by powder metallurgy, generally powder graphite having a particle size of 200 mesh or less is used as a starting powder, whereby the resulting free graphite dispersed in the matrix of the Fe-based sintered alloy has an average particle diameter of 30 μm or less. In contrast, according to the invention, powder graphite having the same particle size as powder graphite generally employed as a starting powder and powder graphite having a relatively coarse particle size, i.e. powder graphite having a particle size of 200 to 30 mesh are used as starting powders such that coarse free graphite having a particle diameter of 70 to 500 μm are dispersed in the matrix of the Fe-based sintered alloy in a ratio of 0.5 to 10 area %.

The above particle diameter and ratio of the coarse free graphite have been empirically determined. If the particle diameter is less than 70 μm, or if the ratio is less than 0.5 area %, a desired excellent lubricating effect cannot be ensured. On the other hand, if the particle diameter exceeds 500 μm, a crash can occur in the resulting alloy, which starts from a coarse free graphite particle, which can lead to breakage of the valve guide member. Further, if the ratio exceeds 10 area %, the resulting alloy has sharply degraded strength. Therefore, the particle size of the coarse free graphite component has been limited to the range of 70 to 500 μm, and the ratio thereof to the range of 0.5 to 10 area %. Preferably, the particle diameter should be limited to a range of 100 to 250 μm, and the ratio a range of 1 to 5 area %.

EXAMPLE

Next, an example of the valve guide member according to the invention will be described hereinbelow.

The following starting powders were blended together into blends having chemical compositions shown in Tables 1 and 2:

Fe powder, particle size: −80 mesh;

C powder, particle size: −200 mesh;

C powder, particle size: 200 to 30 mesh;

Cu powder, particle size: −100 mesh;

Mo powder, particle size: −100 mesh;

Fe−27% P alloy powder, particle size: −150 mesh; and

Cu−8% P alloy powder, particle size: −200 mesh.

1% zinc stearate was added to each of the blends shown in Tables 1 and 2, and then the blends were each mixed for 30 minutes by means of a V-type mixer, followed by press molding the resulting mixture at a pressure of 6 tons/cm$^2$ into a green compact. Further, the thus obtained green compact was degreased in an atmosphere of a cracked natural gas at a temperature of 650° C. for 20 minutes. Subsequently, the degreased green compact was heated to a predetermined temperature within a range of 1050° to 1150° C., and held at the same temperature for 60 minutes to effect sintering, followed by subjecting the sintered body to finish working, to thereby produce valve guide members (hereinafter referred to as "the present invention valve guides") Nos. 1 to 24 having a size of 50 mm in length, 12 mm in outer diameter, and 6.6 mm in inner diameter, and formed of Fe-based sintered alloys according to the present invention which have substantially the same chemical compositions as the respective corresponding blend chemical composition shown in Table 1 or 2, and have a structure having a matrix formed mainly of pearlite, in which are dispersed hard Fe—C—P compounds and free graphite, or alternatively hard Fe—C—P compounds, carbides and free graphite when the alloy contains Mo, the free graphite including coarse free graphite having a particle diameter of 70 to 500 μm in ratios shown in Tables 1 and 2.

To evaluate the wear and abrasion resistance of the present invention valve guides, comparative valve guide members (hereinafter referred to as "the comparative valve guides") Nos. 1 to 4 were produced, which are formed of Fe-based sintered alloys having chemical compositions shown in Table 1. The comparative valve guides Nos. 1 to 4 each have the content of one of the component elements or the ratio of the coarse free graphite falling outside the range of the present invention, as asterisked in Table 1.

Next, the present invention valve guides Nos. 1 to 11 and the comparative valve guides Nos. 1 to 4 obtained as above were each press fitted into a valve guide bore formed in an exhaust side portion of a

TABLE 1

| SPECIMEN | | Fe-BASED SINTERED ALLOY CHEMICAL COMPOSITION (WT %) C | Cu | P | Fe | RATIO OF COARSE FREE GRAPHITE (AREA %) | ABRASION LOSS (μm) |
|---|---|---|---|---|---|---|---|
| PRESENT INVENTION VALVE GUIDES | 1 | 1 (70%) | 3 | 0.3 | BAL. | 2.1 | 21 |
| | 2 | 2 (50%) | 3 | 0.3 | BAL. | 2.5 | 2 |
| | 3 | 3 (40%) | 3 | 0.3 | BAL. | 3.6 | 8 |
| | 4 | 4 (60%) | 3 | 0.3 | BAL. | 7.2 | 12 |
| | 5 | 2 (70%) | 1.5 | 0.3 | BAL. | 4.5 | 19 |
| | 6 | 2 (45%) | 4.5 | 0.3 | BAL. | 2.7 | 5 |
| | 7 | 2 (20%) | 6 | 0.3 | BAL. | 1.2 | 27 |
| | 8 | 2 (90%) | 3 | 0.1 | BAL. | 6.2 | 15 |
| | 9 | 2 (65%) | 3 | 0.8 | BAL. | 4.0 | 15 |
| | 10 | 2 (20%) | 3 | 0.3 | BAL. | 0.54 | 32 |
| | 11 | 4 (90%) | 3 | 0.3 | BAL. | 9.6 | 21 |
| COMPARATIVE VALVE GUIDES | 1 | 0.5 (45%)* | 3 | 0.3 | BAL. | 0.7 | 113 |
| | 2 | 2 (50%) | 1* | 0.3 | BAL. | 2.8 | 78 |
| | 3 | 2 (80%) | 3 | 0.05* | BAL. | 5.1 | 155 |
| | 4 | 2 (0) | 3 | 0.3 | BAL. | 0* | 55 |

Note: The parenthesized values show the percentage of coarse carbon powder to the whole carbon powder. The asterisked values fall outside the range of the present invention.

TABLE 2

| SPECIMEN | | Fe-BASED SINTERED ALLOY CHEMICAL COMPOSITION (WT %) C | Cu | P | Mo | Fe | RATIO OF COARSE FREE GRAPHITE (AREA %) | ABRASION LOSS (μm) |
|---|---|---|---|---|---|---|---|---|
| PRESENT INVENTION VALVE GUIDES | 12 | 1 (50%) | 2.5 | 0.3 | 0.2 | BAL. | 1.5 | 19 |
| | 13 | 2 (45%) | 2.5 | 0.3 | 0.2 | BAL. | 2.7 | 4 |
| | 14 | 3 (60%) | 2.5 | 0.3 | 0.2 | BAL. | 5.4 | 7 |
| | 15 | 4 (75%) | 2.5 | 0.3 | 0.2 | BAL. | 9.1 | 21 |
| | 16 | 2 (85%) | 1.5 | 0.3 | 0.2 | BAL. | 5.1 | 9 |
| | 17 | 2 (45%) | 4.5 | 0.3 | 0.2 | BAL. | 2.7 | 5 |
| | 18 | 2 (10%) | 6 | 0.3 | 0.2 | BAL. | 0.58 | 21 |
| | 19 | 2 (35%) | 2.5 | 0.1 | 0.2 | BAL. | 2.1 | 11 |
| | 20 | 2 (70%) | 2.5 | 0.8 | 0.2 | BAL. | 4.4 | 16 |
| | 21 | 2 (50%) | 2.5 | 0.3 | 0.1 | BAL. | 2.9 | 23 |
| | 22 | 2 (20%) | 2.5 | 0.3 | 1 | BAL. | 1.3 | 28 |
| | 23 | 2 (23%) | 2.5 | 0.3 | 0.2 | BAL. | 0.56 | 20 |
| | 24 | 2 (94%) | 2.5 | 0.3 | 0.2 | BAL. | 9.8 | 12 |

Note: The parenthesized values show the percentage of coarse carbon powder to the whole carbon powder.

cylinder head formed of cast aluminum of a DOHC type engine having a displacement of 2000 cc, and the bores of the valve guides were finish worked. Then, an actual engine-operating test was conducted by actually operating the engine with each of the valve guides mounted therein, using an unleaded gasoline at an engine rotational speed of 6000 rpm and for 500 hours. Similarly, the present invention valve guides Nos. 12 to 24 were each press fitted into the valve guide bore in the exhaust side portion of the cylinder head formed of cast aluminum of the DOHC type engine having a displacement of 2000 cc, and the bores of the valve guides were finish worked. Then, an actual engine-operating test was conducted by actually operating the engine with each of the valve guides mounted therein, using the unleaded gasoline at an engine rotational speed of 6200 rpm and for 450 hours.

Then, the inner diameters of the valve guides were each measured at a portion thereof at a distance of 5 mm from an end edge thereof toward a valve seat in the longitudinal direction. Amounts of change in the inner diameter of each valve guide before and after the test were measured as an abrasion loss. The results of the measurement are shown in Tables 1 and 2.

As is apparent from the results in Tables 1 and 2, all the present invention valve guides Nos. 1 to 24 show very small abrasion loss values, i.e. excellent wear and abrasion resistance even after the engine was continuously operated at a very high speed and for a long time. By contrast, it will be learned from the tables that the comparative valve guides Nos. 1 to 4, in which the content of one of the component elements or the ratio of the coarse free graphite falls outside the range of the present invention, do not possess desired excellent wear and abrasion resistance.

As described above, the valve guide member formed of an Fe-based sintered alloy according to the present invention can exhibit excellent wear and abrasion resistance even when it is used under severe conditions, and therefore can satisfactorily cope with the recent trend toward higher output and higher speed characteristics of internal combustion engines.

What is claimed is:

1. A valve guide member formed of an Fe-based sintered alloy having excellent wear and abrasion resistance, consisting essentially of 1 to 4% C, 1.5 to 6% Cu, 0.1 to 0.8% P, and the balance of Fe and inevitable impurities, said Fe-based sintered alloy having a structure having a matrix formed mainly of pearlite, in which are dispersed hard Fe—C—P compounds and free graphite, said free graphite including 0.5 to 10 area % coarse free graphite having a particle diameter of 70 to 500 μm.

2. A valve guide member as claimed in claim 1, wherein said Fe-based sintered alloy consists essentially of 1.5 to 3% C, 2 to 4% Cu, 0.2 to 0.4% P, and the balance of Fe and inevitable impurities, and wherein said free graphite includes 1 to 5 area % coarse free graphite having a particle diameter of 100 to 250 μm.

3. A valve guide member formed of an Fe-based sintered alloy having excellent wear and abrasion resistance, consisting essentially of 1 to 4% C, 1.5 to 6% Cu, 0.1 to 0.8% P, 0.05 to 1% Mo, and the balance of Fe and inevitable impurities, said Fe-based sintered alloy having a structure having a matrix formed mainly of pearlite, in which are dispersed hard Fe—C—P compounds, carbides, and free graphite, said free graphite including 0.5 to 10 area % coarse free graphite having a particle diameter of 70 to 500 μm.

4. A valve guide member as claimed in claim 3, wherein said Fe-based sintered alloy consists essentially of 1.5 to 3% C, 2 to 4% Cu, 0.2 to 0.4% P, 0.2 to 0.6% Mo, and the balance of Fe and inevitable impurities, and wherein said free graphite includes 1 to 5 area % coarse free graphite having a particle diameter of 100 to 250 μm.

* * * * *